United States Patent [19]

Wagner

[11] Patent Number: 4,637,538

[45] Date of Patent: Jan. 20, 1987

[54] STAPLE REMOVER

[76] Inventor: Wayne M. Wagner, 102 NW. 76th St., Vancouver, Wash. 98665

[21] Appl. No.: 764,590

[22] Filed: Aug. 12, 1985

[51] Int. Cl.[4] ..... B25C 11/00

[52] U.S. Cl. ..... 227/63; 254/28

[58] Field of Search ..... 254/25, 28; 227/63, 227/120

[56] References Cited

U.S. PATENT DOCUMENTS

| | | | |
|---|---|---|---|
| Re. 23,756 | 12/1953 | Juilfs | 227/130 |
| Re. 26,262 | 9/1967 | Juilfs | 227/130 |
| 2,690,561 | 10/1954 | Scheurmann | 227/63 |
| 2,762,604 | 9/1956 | Misson | 254/28 |
| 4,293,119 | 10/1981 | Diederichs | 254/28 |

*Primary Examiner*—Frederick R. Schmidt
*Assistant Examiner*—Judy J. Hartman
*Attorney, Agent, or Firm*—Marger & Johnson

[57] ABSTRACT

A pneumatically powered apparatus for removing staples from upholstered furniture and other surfaces is disclosed. The apparatus includes a pivoted staple pulling bit which has a chisel shaped end portion sized for insertion along a surface beneath a staple. A reciprocating plunger having a cam shaped end portion is in communication with the rear portion of the bit. Forward movement of the plunger forces the cam shaped end against the bit pivoting the chisel shaped end portion upward.

11 Claims, 9 Drawing Figures

STAPLE REMOVER

BACKGROUND OF THE INVENTION

This invention relates generally to stapling, and more particularly to devices which extract or remove staples.

Staple removers are commonly used in the furniture upholstering industry. Upholstery material is generally held in place on furniture by staples which are driven through the material into the wood frame of the furniture by a staple gun. In some cases, six hundred or more staples may be used to affix the upholstery material to the frame of, for example, a large davenport.

When furniture upholstery wears or becomes damaged, it is necessary to remove the staples and old upholstery in order to be able to re-upholster the furniture. Much time and energy is spent in removing the numerous staples which have been driven into the wood frame. Such staples are commonly removed by use of a hand tool such as a claw hammer or screwdriver. Other devices specifically designed for removing staples from upholstery are also used, such as the #711 staple remover provided by C. S. Osborne & Company, 121 Jersey Street, Harrison, N.J. 07029, and the staple removers shown in U.S. Pats. Nos. 4,293,119 to Diederichs, 4,040,556 to Dahle, and 3,563,513 to Rubin. All such tools have the drawback that they are manually operated, requiring much human energy to pry the staples out of the wood frame and upholstery.

Powered staple removers have been developed, such as that shown in U.S. Pat. No. 4,245,817 to Peoples. The device there disclosed is a pneumatically driven, trigger actuated, plier-like extractor. To actuate the device, a trigger is pressed which causes a jawed grabber bar assembly to move downward to compress or penetrate the upholstery material surrounding a staple. Thereafter, a valve opens which causes the jaws to close beneath the staple. Then, another valve opens, which causes the grabber assembly to be pulled upward, thereby removing the staple from the wood frame and upholstery. Such a device is bulky, costly to manufacture due to the complex valving, and slow in operation due to the sequenced movements of the various components.

Accordingly, there remains a need for a powered staple removing apparatus which is compact, simple in its operation, yet provides enough force to remove a staple from a piece of upholstered furniture.

SUMMARY OF THE INVENTION

It is a first object of the present invention to reduce the amount of manual labor required to remove staples from upholstered furniture and other surfaces penetrated by staples.

A second object of the invention is to provide a powered staple removing apparatus which is simple and easy to operate.

A third object of the invention is to provide a staple removing apparatus which is fast in its operation.

A fourth object of the invention is to provide an apparatus for removing staples which is attachable to existing pneumatic powered staple guns.

A fifth object of the invention is to provide a staple removing apparatus which is usable in the tight and narrow confines of certain parts of furniture.

The foregoing and other objects, features, and advantages of the invention will become more readily apparent from the following detailed description which proceeds with reference to the accompanying drawings.

DETAILED DESCRIPTION OF A PREFERRED EMBODIMENT

Figure 1:
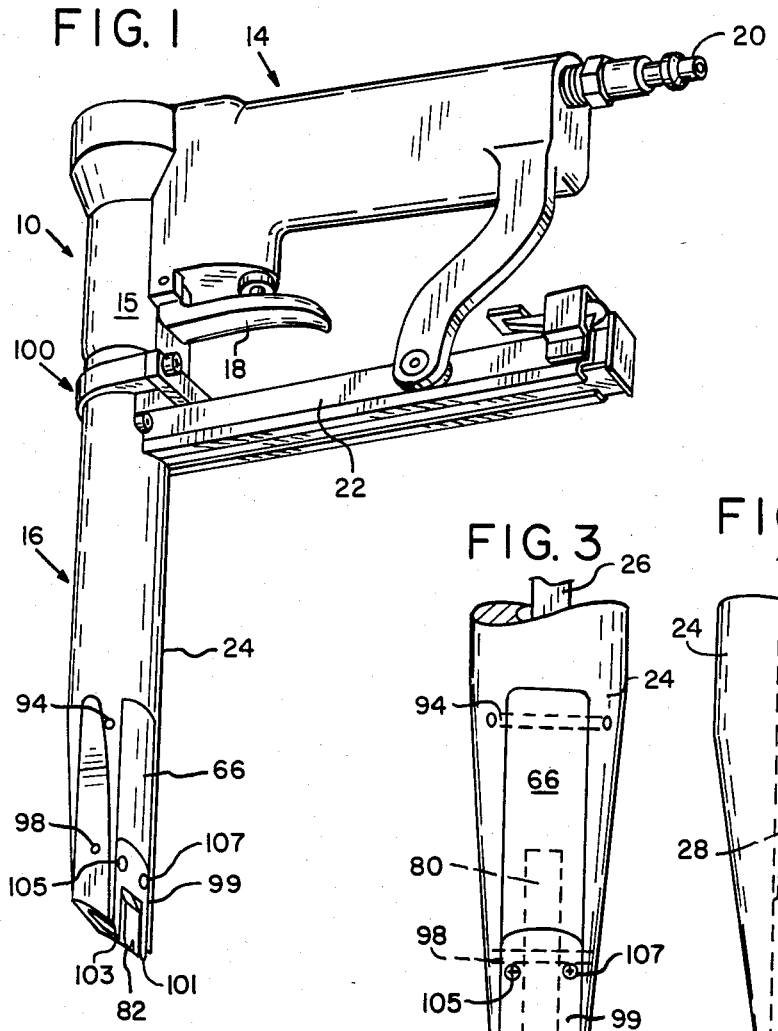
FIG. 1 is a perspective view of a staple remover in accordance with the invention.
Figure 3:
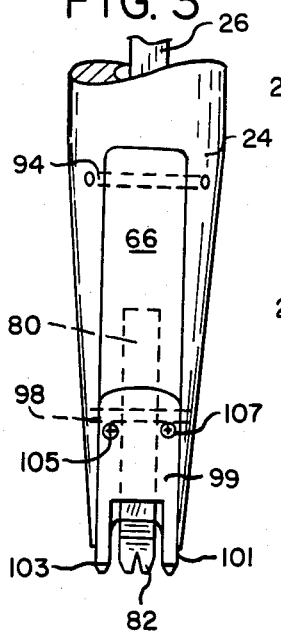
FIG. 3 is a fragmentary view of the nose portion of the staple removing apparatus viewed from beneath the staple removing bit.
Figure 4:
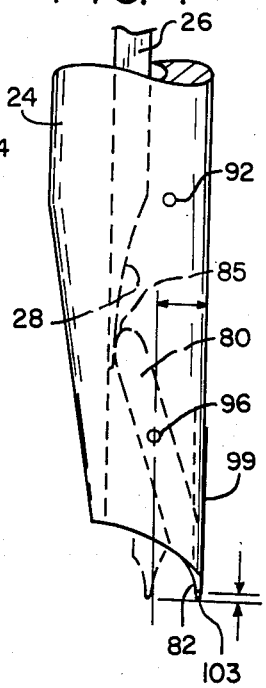
FIG. 4 is a side fragmentary view of the nose portion shown in FIG. 3.
Figure 5:
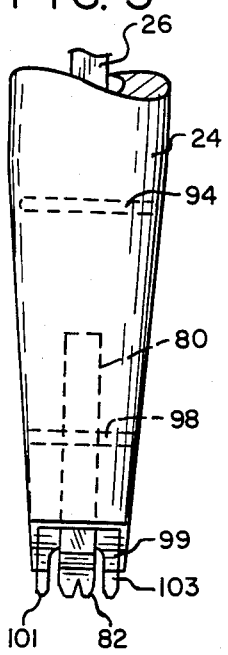
FIG. 5 is a top fragmentary view of the nose portion shown in FIG. 3.

In accordance with the invention, the staple removing apparatus can be either constructed as an attachment for commercially available powered staplers or as a complete, self-contained, workable unit. The embodiment here described refers to the attachment version of the invention.

Referring to FIGS. 1–6, an apparatus 10 for removing staples 12 from a surface penetrated by staples, includes a hand-holdable rear portion 14 and an elongated projecting nose portion 16.

The hand-holdable rear portion 14 is a commercially available pneumatic stapler such as that shown in U.S. Pat. No. Re. 26,262 to Juilfs. Rear portion 14 includes a trigger 18 and a male connector 20 for receiving a female configured air hose 21. Rear portion 14 also includes a staple supply magazine 22 (not utilized for purposes of this invention) which extends downward from the forward portion 15 of hand holdable rear portion 14.

Figure 6:
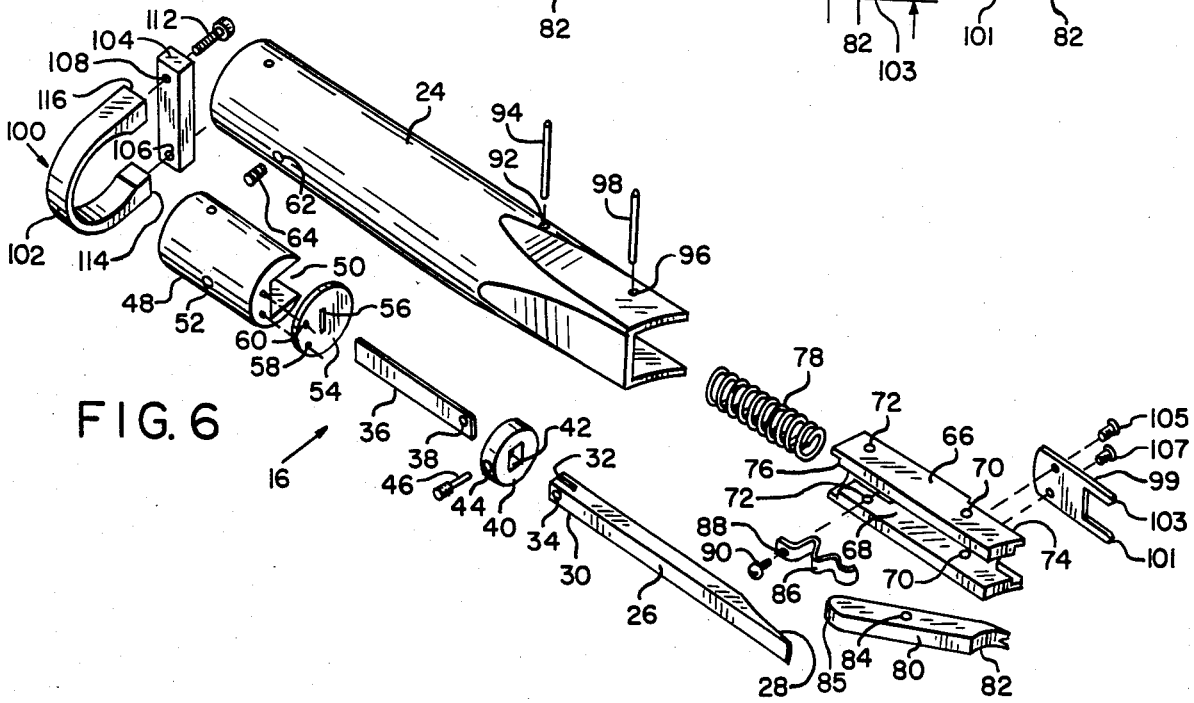
FIG. 6 is an exploded view of the staple remover attachment showing details of assembly.
Figures 2, 7, 8, 9:
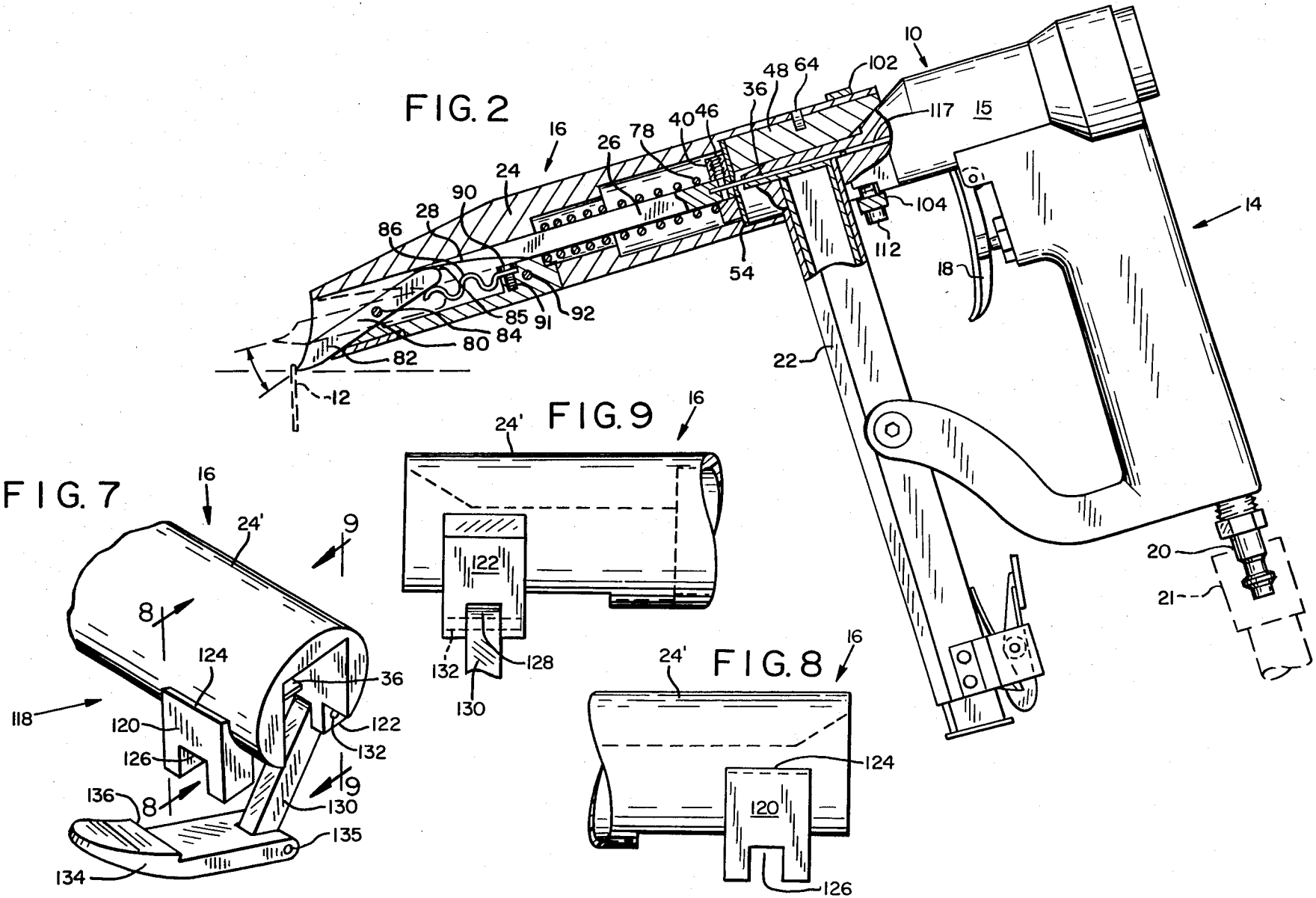
FIG. 2 is a side elevational view, partly in section, of the apparatus of FIG. 1.
FIG. 7 is a perspective view of the rear end of another embodiment of a staple remover in accordance with the invention.
FIG. 8 is a cross sectional view taken along line 8—8 in FIG. 7.
FIG. 9 is a cross sectional view taken along line 9—9 in FIG. 7.

Referring more particularly to FIGS. 2 and 6, nose portion 16 is comprised of a number of cooperating components which fit within a narrow, elongate plastic or metal hollowed body portion or casing 24 sized for insertion into narrow openings in upholstered furniture. The various components will be described in relation to one another as one would encounter when assembling the device.

A rectangular cross section elongate plunger 26 is mounted for reciprocation lengthwise in the casing. The plunger includes a forward cam shaped end portion 28 and a slotted rear portion 30. Rear portion 30 has a horizontal slit 32 extending into the rear edge and across the rear width of plunger 26. A vertical hole 34 extends through rear portion 30 and slit 32. A thin, platelike driver member 36 of the same width as plunger 26 is configured for insertion in horizontal slit 32. The forward end of driver member 36 includes a hole 38. A retainer 40 is included to fix driver member 36 within slot 32. Retainer 40 includes a circular body portion having a rectangular passageway 42 through its center for slidably receiving rear portion 30 of correspondingly shaped plunger 26. A vertical threaded hole 44 extends from an upper edge surface of retainer 40 to rectangular passageway 42. Retainer 40, plunger 26 and driver 36 are positioned such that their holes 44, 34, and 38 are in alignment. A locking pin 46 threaded at its upper end extends through holes 44, 34, and 38. The threaded upper end of locking pin 46 is threadingly received in hole 44 of retainer 40, thereby fixing the plunger, driver and retainer relative to one another.

A spring 78, the purpose of which is described below, with an internal diameter large enough to receive rectangular plunger 26, is slid over plunger 26 and rests against retainer 40. The assembled plunger, spring, driver and retainer are slid into the rear portion of hollowed body 24. A keeper 48 is provided at the rear of hollowed body 24 to limit rearward movement of the plunger, driver and retainer. Keeper 48 is internally inletted to fit in complementary fashion to forward portion 15 of hand holdable rear portion 14. The shape of keeper 48 is determined according to the model of the pneumatic staple gun used as the hand holdable rear portion. Here, the outer portion of keeper 48 is of the same general shape of the hollow cross section of body 24 and includes an internal downward, rectangular opening 50 which extends the axial length of the keeper. Slightly different shaped keepers are used for different models of pneumatic staple guns. Keeper 48 also includes a threaded hole 52 which extends vertically from the top central portion of keeper 48 to rectangular opening 50. The width of rectangular opening 50 is wider than the width of driver member 36 such that driver 36 is slidably received therein. A driver member guiding plate 54 having a thin rectangular slot 56 at its center adapted for slidably receiving driver 36 is provided forward of keeper 48. Plate 54 includes two holes 58, 60 which receive screws or locking pins (not shown) which fix the position of plate 54 relative to keeper 48.

Continuing with the assembly of the device, keeper 48 with plate 54 forwardly affixed is slid into the rear of hollowed body 24 such that horizontal slit 56 slidably receives driver member 36. Threaded opening 52 of keeper 48 is aligned with a threaded hole 62 in the top of body member 24. A locking screw 64 is then threaded through holes 62 and 52, thereby longitudinally fixing the position of keeper 48 within body 24. The plunger-retainer-driver combination is thereby slidably retained within body 24 and adapted for reciprocal movement.

Attention is now drawn to components configured in the forward end of body member 24. An elongated bit mounting member 66 includes a channel portion 68 which extends in the middle and along the length of member 66. Mounting member 66 includes a forward portion 74 and an indented recessed rear portion 76. Indented recessed rear portion 76 retains coil spring 78. Holes 70 and 72 extend through the respective forward and rear side edges of member 66 to the channel portion.

A staple pulling bit means, in the form of a pivoting bit member 80, has a V-notched chisel shaped end portion 82 with a width sized for insertion along a surface beneath a staple 12. The width of bit member 80 is also sized to be received within channel 68 of bit mounting member 66. A hole 84 extends through the side edges of the central portion of bit mounting member 80.

A biasing means in the form of a spring 86 is included for pressing chisel shaped end portion 82 of bit member 80 against the surface penetrated by the staple. Spring 86 includes a hole 88 in its rear portion. Spring 86 is clamped rearward in channel 68 of bit mounting member 66 by a screw 90 which is slidably received in hole 88 and threadingly received in a corresponding hole 91 in the rear of bit mounting member 66.

To complete assembly of nose portion 16, bit mounting member 66, with biasing spring 86 firmly attached, is slid into the forward end of body member 24. Bit mounting member 66 is then forced against spring 78 such that holes 72 in the bit mounting member align with holes 92 which extend through the sides of body 24. A pin 94, sized to extend the outer width of body member 24, is then slid through holes 92 and 72, thereby fixing bit mounting member 66 longitudinally within the forward portion of nose body 24. Then, bit member 80, with chisel shaped end portion 82 facing towards the forward end of body 24, is slid into channel 68 of bit mounting member 66. Bit member 80 is positioned within channel 68 against biasing spring 86 until hole 84 in bit member 80 aligns with hole 70 in mounting member 66 and holes 96 which extend through the sides of body 24. Thereafter, a pin 98, sized to extend the width of body 24, is inserted through holes 96, 70 and 80, thereby pivotally mounting the bit member intermediate its ends in the forward portion of bit mounting member 66. In this way, pin 98 serves to both aid pin 94 in fixing the position of bit mounting member 66 within the forward portion of body 24 and to serve as the pivot rod for staple pulling bit 80.

A plate member 99 with two pointed forward members 101 and 103 is bolted to the forward underside of body portion 24 with bolts 105 and 107. Forward edges 101 and 103 provide a bearing surface for body portion 24 when a staple is being removed.

Spring 86 serves to bias the rear portion of bit member 80 upward and thereby chisel shaped end portion 82 downward for pressing portion 82 against the surface penetrated by the staple. Spring 78 serves to bias plunger 26 away from the bit member 80 and to position driver 36 properly relative to the pneumatic staple gun. In this configuration, the plunger 26 is adapted for reciprocal movement relative to bit member 80. Cam shaped end portion 28 of plunger 26 provides a translation means which is adapted to contact the rear portion of bit member 80, whereby reciprocal movement of the plunger is translated into movement of the bit means transverse of the plunger. The Juilfs stapler shown herein provides the means for moving plunger 26 reciprocally with respect to bit member 80.

Cam shaped end portion 28 is configured with a curved, decreasing radius cam surface. This assures, for a single plunger stroke, that initial force generated by a distance of plunger movement is greatest while initial movement of the bit means is least. Force generated by a subsequent distance of shaft movement, for the same plunger stroke, is less than the initial force and movement of the bit means is greater than the initial movement. It is desirable to produce this decreasing force as the chisel portion moves upward because an increasing or constant force would tend to fling the staple from the surface and possibly injure the operator or other person. Also, the further the staple is in the furniture or other surface, the more force is initially required to move the staple. The decreasing radius cam surface assures that this initial force will be greatest where it is needed most.

The rear portion of bit member 80 can also include a cam shaped surface 85 as shown. Surface 85 is shaped to add to the above effect produced by cam surface 28 of plunger 26. This compound cam effect further maximizes the force available by initial movement of plunger 26.

Means for attaching body 24 to the pneumatic powered staple gun such as that shown in the Juilfs patent is provided in the form of a collar 100. Collar 100 includes a semi-circular surrounding collar member 102 and a clamping portion 104. Clamping portion 104 includes holes 106 and 108 which slidably receive threaded bolts 110, 112. Bolts 110, 112 are threadingly received in holes 114 and 116, which extend into the ends of member 102. Collar 100 securely fastens projecting nose portion 16 to forward portion 15 of the Juilfs stapler. This arrangement assures proper alignment of driver 36 relative to an actuating rod 117 in forward end 15 of the Juilfs stapler.

An alternate means for attaching body 24 to the pneumatic staple gun is shown in another embodiment in FIGS. 7–9. Here, the collar means 118 is formed as an integral part of the rear portion of cylindrical body portion or casing 24'. Body portion 24' can be made from a heat molded plastic process and includes two parallel, downward-projecting members 120 and 122. The side upper portion of member 120 protrudes outward from the surface of the casing to form a narrow axially-extending ledge 124. Aligned rectangular grooves 126 and 128 are included in the underside bottom portion of members 120 and 122. Groove 128 is in member 122 while groove 126 in in member 120. Grooves 126 and 128 are sized to slidably receive a square, elongate cross-linking member 130 tangentially of the casing. One end of square cross-linking member 130 is hinged within groove 128 by a pivot pin 132 which extends through member 122, groove 128, and cross-linking member 130. The other end of member 130 is hinged to a locking member 134 by a pivot pin 135. Locking member 134 includes an notched end portion 136 which snap-locks onto ledge 124 of member 120.

This latter attaching means is operable by first sliding the rear end of body 24', with locking member 134 disengaged, into position with the pneumatic staple gun. Thereafter, cross-linking member 130 and locking member 134 are swung upward between trigger 18 and staple magazine 22. Member 130 pivots into groove 126. Notched portion 136 of locking member 134 is then snap locked onto notch or extrusion 124 of member 120, thereby attaching nose portion 16 to the staple gun. This embodiment enables quick and easy attachment and removal of nose portion 16 to the staple gun.

OPERATION

To use the device, an operator grasps handle portion 14 and positions chisel shaped end portion 82 along a surface beneath a staple. Thereafter, trigger 18 is compressed which opens an air valve and drives a piston in the Juilfs device forward (not shown). Rod 117 in the Juilfs device connected to the piston forces against driver member 36, pushing plunger 26 and retainer 40 forward against the biasing force of spring 78. The cam shaped end portion 28 of plunger 26 engages the rear portion of bit member 80. Forward movement of the plunger causes the rear portion of bit member 80 to pivot downward against biasing spring 86 and chisel shaped end portion 82 to pivot upward against the staple. This lever action pulls the staple upward and removes it from the stapled surface. Thereafter, air pressure is released by releasing trigger 18, allowing spring 78 to force plunger 26, retainer 40, and driver 36 rearward. Bit member biasing spring 86 correspondingly forces the rear portion of bit member 80 upward and chisel shaped end portion 82 downward, thus returning end portion 82 to its resting position.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

I claim:

1. An apparatus for use in combination with a pneumatic powered staple gun for removing staples from a surface penetrated by a staple, comprising:

an elongate casing having an open nose end;

staple pulling bit means having a chisel shaped end portion with a predetermined length and a width sized for insertion lengthwise along a surface beneath a staple;

means for pivotally mounting the bit means in the casing adjacent the nose end;

a plunger adapted for reciprocal movement lengthwise within the casing relative to the bit means;

translation means mounted on the plunger and adapted to contact the bit means for translating reciprocal movement of the plunger into movement of the bit means transverse of the plunger;

means for moving the plunger reciprocally lengthwise in the casing with respect to the bit means;

means for attaching a rear end portion of the casing opposite said open nose end to a pneumatic powered staple gun; and means disposed in said rear end portion of the casing for reciprocably coupling the plunger to a driver in the staple gun.

2. An apparatus according to claim 1 in which the translation means comprises an elongated shaft connected to the plunger and having a cam shaped end portion for engaging the bit means.

3. An apparatus according to claim 2 further comprising biasing means for pressing the chisel shaped end portion of the bit means against the surface penetrated by the staple.

4. An apparatus according to claim 2 in which the staple-pulling bit means is an elongated, substantially straight member pivotally mounted intermediate its ends.

5. An apparatus according to claim 4 in which the staple pulling bit means includes a rear portion having a cam shaped end portion.

6. An apparatus according to claim 5 in which the cam shaped end portion on the plunger and the cam shaped rear portion of the bit means comprise a compound cam concavely curved along the length of the shaft so as to provide a first, shallow inclination adjacent the end thereof and a second inclination greater than the first inclination at a position spaced lengthwise from the first inclination such that, for a single plunger stroke, initial force generated by a distance of plunger movement is greatest and initial movement of the bit means is least while a force generated by a subsequent distance of shaft movement is less and movement of the bit means is greater.

7. An apparatus according to claim 2 in which the cam shaped end portion on the plunger comprises a cam surface concavely curved along the length of the shaft so as to provide a first, shallow inclination adjacent the end thereof and a second inclination greater than the first inclination at a position spaced lengthwise from the first inclination such that, for a single plunger stroke, initial force generated by a distance of plunger movement is greatest and initial movement of the bit means is least while a subsequent force generated by a subsequent distance of shaft movement is less and movement of the bit means is greater.

8. An apparatus according to claim 1 in which the plunger is biased away from the bit means.

9. An apparatus according to claim 1 in which the attaching means comprises a collar.

10. An apparatus according to claim 1 which includes a cross-linking member hinged on a first side of the rear end portion for pivoting transverse with respect to the rear end portion, the cross-linking member including a free end portion which pivotally receives a locking member, the locking member being releasably lockable to a second side of the rear end portion opposite the first side.

11. An apparatus according to claim 1 in which the bit means is substantially straight and positioned within the casing with the chisel shaped end portion protruding lengthwise from the open nose end of the casing so that said transverse movement of the bit means causes the end portion to move normal to the width thereof and thereby pull a staple in a direction normal to the length of the body.

* * * * *